US010297903B2

(12) United States Patent
Yu et al.

(10) Patent No.: US 10,297,903 B2
(45) Date of Patent: May 21, 2019

(54) WIDE BAND ANTENNA BACKED BY REFLECTING CAVITY AND AN ANTENNA SYSTEM

(71) Applicant: SPEED WIRELESS TECHNOLOGY INC., San Jose, CA (US)

(72) Inventors: Bin Yu, Suzhou (CN); Xitong Wu, Suzhou (CN); Kang Yang, Suzhou (CN)

(73) Assignees: SPEEDLINK TECHNOLOGY INC., Cupertino, CA (US); HUIZHOU SPEED WIRELESS TECHNOLOGY CO., LTD, Guangdong (CN)

( * ) Notice: Subject to any disclaimer, the term of this patent is extended or adjusted under 35 U.S.C. 154(b) by 35 days.

(21) Appl. No.: 15/729,629

(22) Filed: Oct. 10, 2017

(65) Prior Publication Data

US 2019/0006738 A1 Jan. 3, 2019

(30) Foreign Application Priority Data

Jun. 30, 2017 (CN) ..... 2017 1 0527218

(51) Int. Cl.

| | |
|---|---|
| ***H01Q 1/24*** | (2006.01) |
| ***H01Q 1/50*** | (2006.01) |
| ***H01Q 5/50*** | (2015.01) |
| ***H01Q 9/04*** | (2006.01) |
| ***H01Q 15/14*** | (2006.01) |

(52) U.S. Cl.

CPC ..... *H01Q 1/243* (2013.01); *H01Q 1/50* (2013.01); *H01Q 5/50* (2015.01); *H01Q 9/045* (2013.01); *H01Q 15/14* (2013.01)

(58) Field of Classification Search

CPC ..... H01Q 1/243; H01Q 1/50; H01Q 5/50; H01Q 5/55; H01Q 9/045; H01Q 15/14; H01Q 15/18; H01Q 13/18

See application file for complete search history.

(56) References Cited

U.S. PATENT DOCUMENTS

| | | | | |
|---|---|---|---|---|
| 8,125,394 | B2 * | 2/2012 | Chiang | H01Q 9/30 343/702 |
| 2016/0351996 | A1 * | 12/2016 | Ou | H01Q 1/241 |
| 2017/0201011 | A1 * | 7/2017 | Khripkov | H01Q 1/243 |
| 2018/0062256 | A1 * | 3/2018 | Kim | H01Q 1/243 |

* cited by examiner

*Primary Examiner* — Robert Karacsony

(74) *Attorney, Agent, or Firm* — Womble Bond Dickinson (US) LLP

(57) ABSTRACT

The disclosure relates generally to a broadband antenna element with a reflecting cavity, which includes a metal frame, a feeder line, a feed screw, a pillar and an insulating sleeve. The reflecting cavity is formed by the inner concave of the outer side of the metal frame. The reflecting cavity includes the first wall and the second wall distributed from bottom to top. The first wall, the pillar, the second wall and the feeder line are arranged orderly and are connected with the feed screw. The pillar and the feed screw are connected by screw thread. The feed screw is connected with the second wall through an insulating sleeve. The pillar is a good conductor and under surface of the pillar contacts with the first wall, and the under surface area of the pillar is larger than the upper surface area of the pillar.

20 Claims, 15 Drawing Sheets

WIDE BAND ANTENNA BACKED BY REFLECTING CAVITY AND AN ANTENNA SYSTEM

RELATED APPLICATIONS

This application claims the priority of Chinese patent application No. 201710527218.6, filed Jun. 30, 2017, which is incorporated by reference in its entirety.

FIELD OF THE DISCLOSURE

This disclosure relates generally to technical field of antennas. More specifically, this disclosure relates to a wide band antenna element with a reflecting cavity and an antenna system.

BACKGROUND

Fifth generation (5G) technology faces the human information society after 2020. The predictable features of 5G technology, such as high data rate, low latency, mass devices connection and low power consumption, will play a very important role in the future society, even though the related technologies are not finalized. As the key component of 5G terminal device, 5G terminal antenna will play an active and important role in promoting the development of the new generation mobile communication system and 5G mobile terminals.

Different from the omnidirectional radiation pattern of 4G mobile terminals, 5G mobile terminals need an antenna array that operates at millimeter wave band to realize beam forming function, but the antenna array at mobile terminals is different from the one of the station. In base station, several 5G base station antenna demos have been demonstrated due to the less restrictions on antenna size and the support of the relatively mature phased array technology. But in mobile terminals, the coexistence of the 5G antenna and the existing generation (2G), third generation (3G), fourth generation (4G), global positioning system (GPS), WiFi, and Bluetooth (BT) antennas is quite challenging due to the narrow antenna and complicated metal environment of mobile terminals.

SUMMARY

This disclosure relates generally to an antenna and antenna system applied in metal back cover of 5G mobile terminals, which aims to realize the coexistence of 5G antenna and the existing 2G/3G/4G/GPS/WIFI/BT antennas.

In order to realize the above purpose, this disclosure provides a wide band antenna element with a reflecting cavity, where the reflecting cavity includes a metal frame, a feeder line, a feed screw, a pillar, and an insulating sleeve. The reflecting cavity is formed by the inner concave of the outer side of the metal frame. The reflecting cavity includes a first wall and a second wall distributed from bottom to top. The first wall, the pillar, the second wall, and the feeder line are arranged orderly and are connected with the feed screw. The pillar and the feed screw are connected by screw thread. The feed screw is connected with the second wall through an insulating sleeve. The pillar is a good conductor and the under surface of the pillar contacts with the first wall, and the under surface area of the pillar is larger than the upper surface area of the pillar.

Placed on the metal frame of the 5G mobile terminal, the 5G antenna can be integrated with 2G/3G/4G/GPS/WIFI/BT antennas. The reflecting cavity can change a radiation direction of the 5G antenna, so that the electromagnetic radiation that human suffers can be reduced. For example, it is quite necessary to reduce the radiation on the front of the mobile terminal when the user is on the phone. In addition, if the reflecting cavity is fed by the feed screw, the bandwidth of the antenna will be quite narrow due to the big impedance difference between the feed screw and the reflecting cavity. The pillar in the reflecting cavity forms a gradual transition structure between the feed screw and the first wall of the cavity, which can properly improve the impedance bandwidth of the antenna element.

Further, the shape of the longitudinal-section of the pillar is a trapezoid with curved edge or a trapezoid with straight edge or a step shape. The shape of the cross-section of the pillar is an arch shape which is the combination of a semicircle and a rectangular. Further, the length, width, and height of the reflecting cavity are $\frac{1}{2}\lambda\sim\lambda$, $\frac{1}{10}\lambda\sim\frac{1}{2}\lambda$, and $\frac{1}{8}\lambda\sim\frac{1}{2}\lambda$ ($\lambda$ is the wavelength of 28 Gigahertz (GHz) in free space), respectively. The length, width, and height of the pillar are $\frac{3}{16}\lambda\sim\frac{3}{8}\lambda$, $\frac{1}{8}\lambda\sim\frac{1}{4}\lambda$, and $\frac{1}{15}\lambda\sim\frac{1}{8}\lambda$, respectively. The long side of the pillar parallels to the broadside of the reflecting cavity. The reflecting cavity with the above parameters can reduce most backward radiation of the antenna.

Further, the length, width, and height of the reflecting cavity are $\frac{1}{2}\lambda\sim\lambda$, $\frac{1}{10}\lambda\sim\frac{1}{2}\lambda$, and $\frac{1}{8}\lambda\sim\frac{1}{2}\lambda$ ($\lambda$ is the wavelength of 28 GHz in free space), respectively. The ratio of the reflecting cavity's length to the pillar's length is 12:5, and the ratio of the reflecting cavity's width to the pillar's width is 11:5, and the ratio of the reflecting cavity's height to the pillar's height is 3:2. The long side of the pillar parallels to the broadside of the reflecting cavity. Further, the length of the end part of the feeder line is $0.08\lambda\sim0.12\lambda$, and its width is $0.08\lambda\sim0.12\lambda$. Further, the feed screw includes a screw head and a screw column, and the screw head is located at one end of the feed screw that is close to the first wall.

Further, the reflecting cavity can be filled with low loss materials whose permittivity is larger than 1 and dielectric loss is less than 0.02, for example, plastic. The reflecting cavity can be filled with different materials or filled partially, and the filling method can be used for nano injection molding. The detail filling methods and materials can be according to the beam scanning range of the antenna. When the reflecting cavity is filled with plastic material, the distance between elements can be reduced and the bandwidth of the antenna will be also reduced, and the coupling between elements will be increased, and the radiation efficiency of the antenna will be decreased. If it is necessary, the reflecting cavity be filled with air.

Further, the metal frame is a U-shaped frame which is placed at the topside of the mobile device, and the antenna elements are distributed along the U-shaped frame. The radiation pattern of the elements along the U-shaped frame is an end-fire radiation and the gain of the antenna is high, and the beam width and the beam scanning angle is wide. Further, the reflecting cavity and the pillar are connected with each other and are formed by opening slot on the metal frame through a computer numerical control (CNC) process.

Further, this disclosure describes a mobile terminal system with above mentioned antenna systems includes a radio frequency (RF) frontend module, a main processor, and base band transceiver module. Its features are as follows. The mobile terminal system can include any antenna systems of claim 1-10 in this disclosure. The RF frontend module includes a 5G RF frontend module and a 2G/3G/4G/GPS/WIFI/BT RF frontend module and above mentioned two RF frontend module are connected by a signal switch which is connected with base band transceiver module. The base band signal can be switched between the 5G RF frontend module and the 2G/3G/4G/GPS/WIFI/BT RF frond-end module through the signal switch, and the above two signal links can use the top side frame of the mobile terminal together to realize the receiving and transmitting of the RF signals. The 5G antenna of this disclosure can coexist with the 4G diversity antenna and does not interfere with each other.

The 5G antenna in this disclosure can be integrated with the 2G/3G/4G/GPS/WIFI/BT antennas, and has a wide bandwidth, a high gain, a wide beam and a wide beam scanning angle. Because of the complicated electromagnetic environment of metal case mobile terminals and the coexistence with the 2G/3G/4G/GPS/WIFI/BT antennas, the 5G antennas are mainly slot antennas and slot antennas with a reflecting cavity which are more suitable for integration on the metal case mobile terminal.

Compared with slot antennas, slot antennas with a reflecting cavity has a more stable radiation pattern, a better directivity and a higher gain, and the antenna performance is less sensitive to the electromagnetic environment of the mobile terminals, so the antenna is more suitable for the metal case mobile terminal. Meanwhile, the slot antennas with a reflecting cavity will not bring any interferences to the existing 2G/3G/4G/GPS/WIFI/BT antennas. Stable performance, outstanding interference immunity, and good compatibility with existing antennas, this is exactly what 5G millimeter wave terminal antennas require.

DETAILED DESCRIPTION

Figure 1:
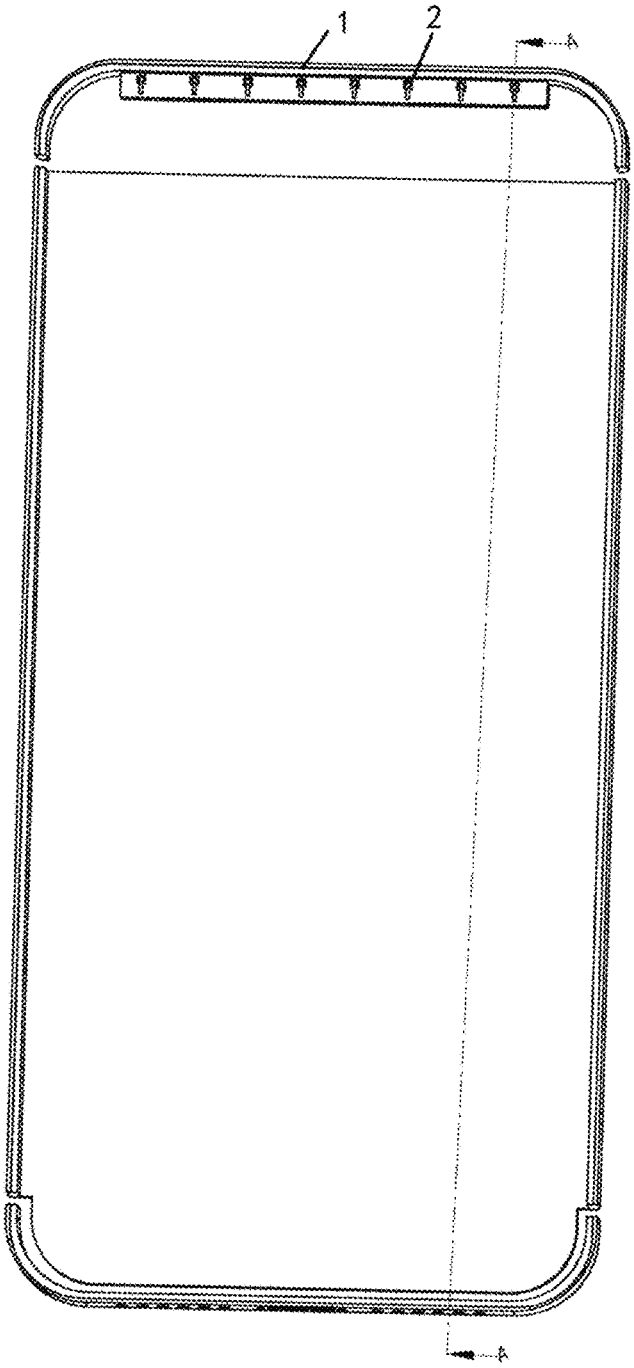
FIG. 1 illustrates an example front view of a 5G mobile terminal in accordance with this disclosure.
Figure 2:
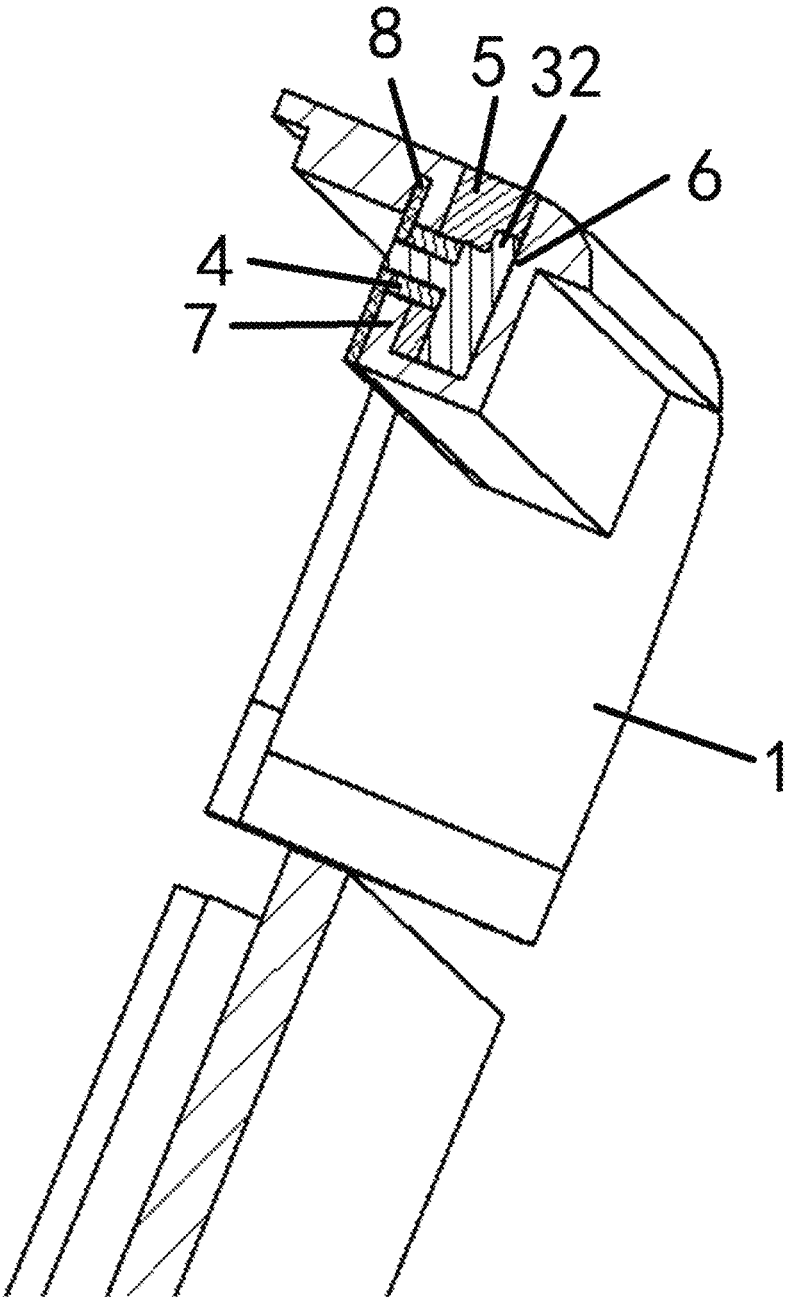
FIG. 2 illustrates an example profile of the antenna element along AA line in FIG. 1 in accordance with this disclosure.
Figure 3:
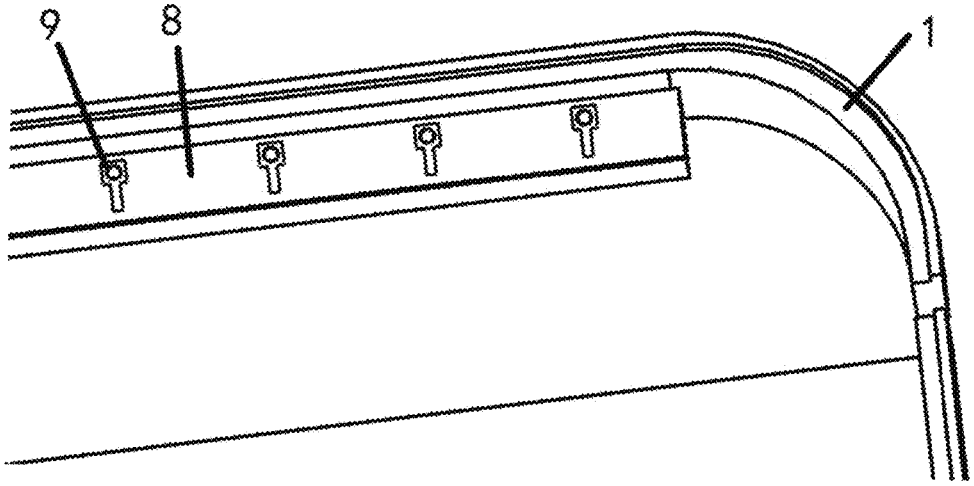
FIG. 3 illustrates an example enlargement schematic of the antenna element structure in FIG. 1 in accordance with this disclosure.
Figure 4:
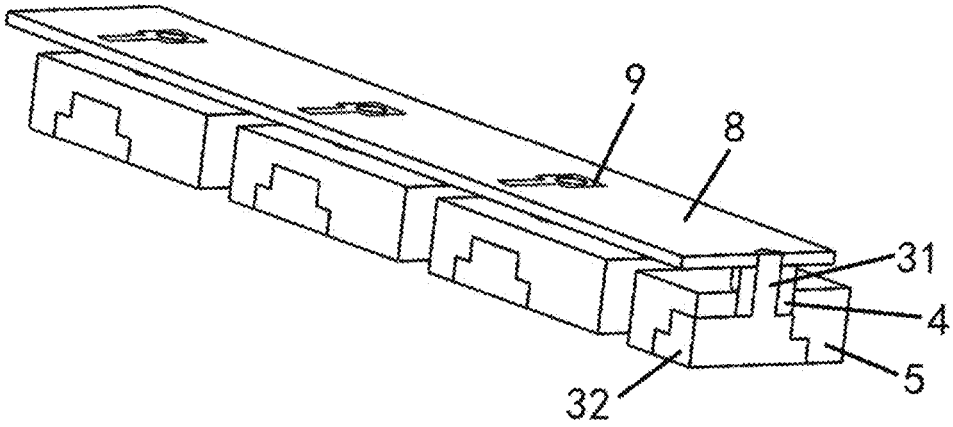
FIG. 4 illustrates an example profile of the antenna element structure without metal frame in FIG. 1 in accordance with this disclosure.
Figure 5:
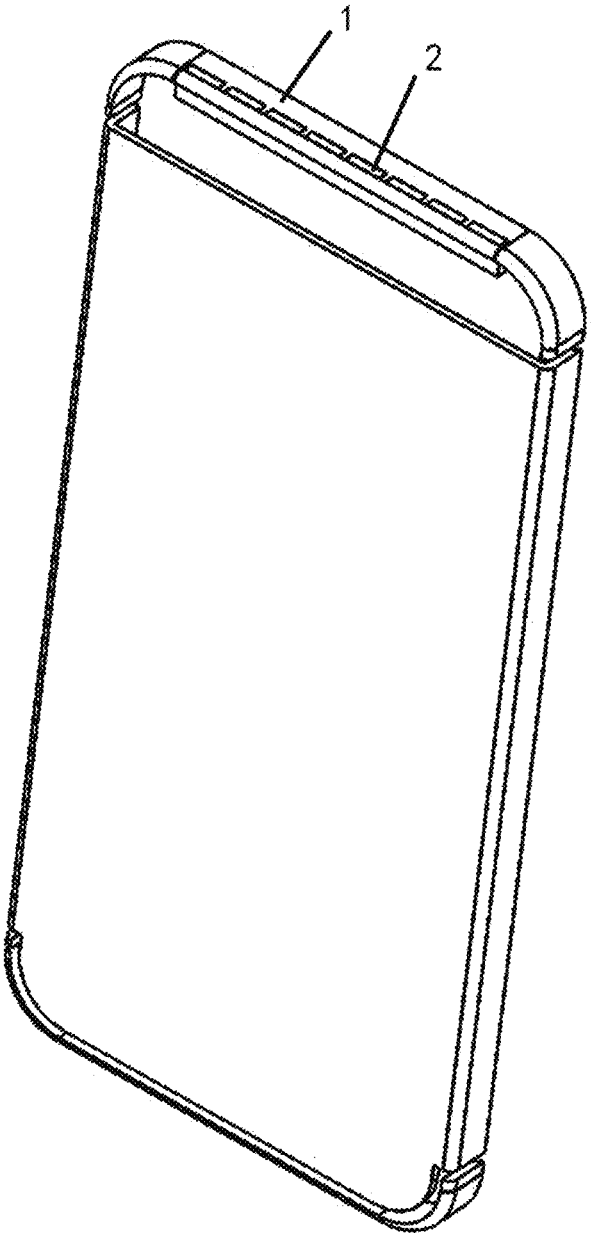
FIG. 5 illustrates an example back view of a 5G mobile terminal in FIG. 1 in accordance with this disclosure.
Figure 6:
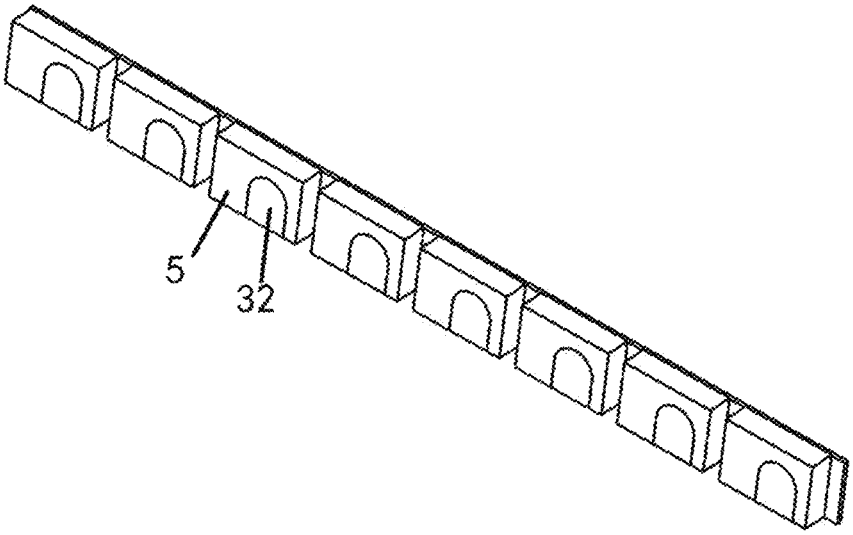
FIG. 6 illustrates an example schematic of the antenna structure without the metal frame in accordance with this disclosure.
Figure 7:
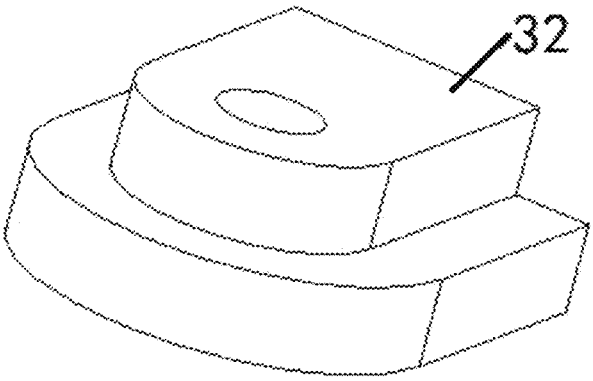
FIG. 7 illustrates an example schematic of a pillar structure in accordance with this disclosure.
Figure 8:
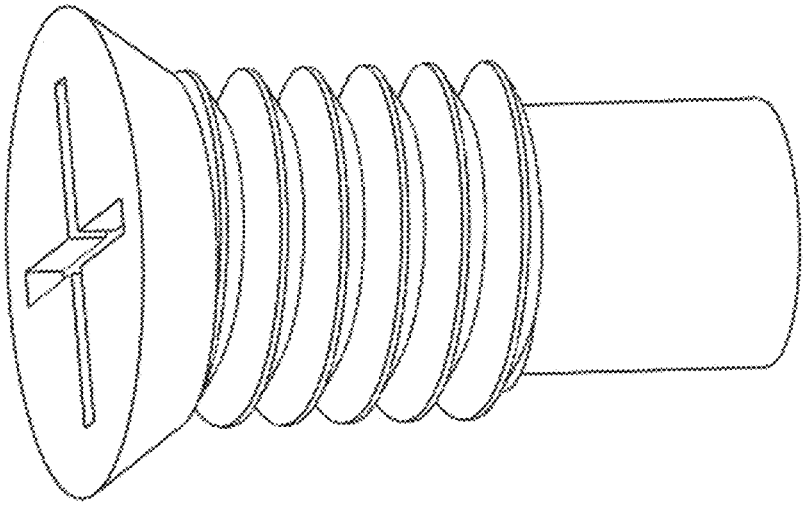
FIG. 8 illustrates an example schematic of the feed screw structure in embodiment A in accordance with this disclosure.

Figures discussed above, and the various embodiments used to describe the principles of the invention in this patent application are by way of illustration only and should not be construed in any way to limit the scope of the invention. Drawings and embodiments are provided so that the invention will be thorough and complete and will fully convey the scope of the invention to those skilled in the art.

Description of appendix mark: 1 denotes metal frame, 2 denotes antenna element, 31 denotes feed screw, 32 denotes pillar, 4 denotes insulating sleeve, 5 denotes low loss material, 6 denotes the first wall, 7 denotes the second wall, 8 denotes main PCB, 9 denotes feeder line, 11 denotes antenna array, 12 denotes RF frontend module, 13 denotes receiving and processing circuit, 14 denotes transmitting and processing circuit, 15 denotes speaker, 16 denotes microphone, 17 denotes main processor, 18 denotes input and output port, 19 denotes keyboard, 20 denotes screen, 21 denotes memory, A zone denotes the position of LTE diversity antenna, GPS/WIFI/BT antennas and 5G antenna, B zone denotes the position of LTE main antenna.

Embodiment A

FIGS. 1 to 8 illustrate a wide band antenna array with reflecting cavities, each of which includes a U-shaped metal frame at the top of the terminal, feeder lines and eight elements that are arranged linearly on the metal frame. The antenna element includes a feed screw, a pillar, an insulating sleeve, and a reflecting cavity. The reflecting cavity is formed by an inner concave of an outer side of the metal frame. The reflecting cavity includes a first wall and a second wall distributed from bottom to top. The first wall, the pillar, the second wall, the feeder line are arranged orderly and are connected with the feed screw. The pillar and the feed screw are connected by screw thread. The feed screw is connected with the second wall through an insulating sleeve. The pillar is a good conductor and the shape of its cross-section an arch shape which is the combination of a semicircle and a rectangular and under surface of the pillar contacts with the first wall. The under surface area of the pillar is larger than the surface area of the pillar, and between the upper and under surfaces is a gradient ladder. The head of the feed screw is near the first wall.

The implementation procedures of this embodiment can be organized as follows: the reflecting cavity and the pillar are formed by opening a slot on the metal frame through a CNC process. The feed screw passes through the holes that are drilled in the first wall, the pillar, and the second wall, orderly. Then the insulating sleeve is penetrated through a hole of the second wall and is sheathed on the feed screw. The feed screw passes through the hole in a printed circuit board (PCB) and the hole on the feeder line, and then the feed screw and the feeder line are welded together. Therefore, the first wall of the cavity and the feeder line are connected by the feed screw. The above mentioned processes and components constitute a complete feeding structure. The shape of the pillar, the filling materials of the cavity, and the filling methods can be selected according to the requirements of this embodiment.

Embodiment B

Figure 9:
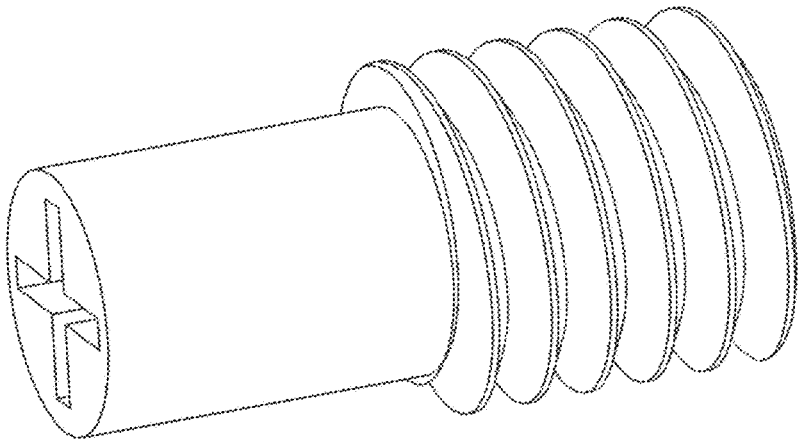
FIG. 9 illustrates an example schematic of the feed screw structure in embodiment B in accordance with this disclosure.

FIGS. 1 to 7 and FIG. 9 illustrate a 5G antenna element that is similar to the one in Embodiment A. The difference is that the head of the feed screw is near the second wall. As illustrated in FIG. 9, the screw thread is disposed on the opposite side of the screw head. The diameter of the screw head equals to the diameter of the screw bolt. The screw head with a or a linear groove facilitates the screw to be installed into the hole in the pillar.

The implementation procedures of this embodiment can be organized as follows: the reflecting cavity and the pillar are formed by opening a slot on the metal frame through a CNC process. The feed screw passes through the holes that are drilled in the second wall and the pillar, orderly. Then the insulating sleeve is penetrated through the hole of the second wall and is sheathed on the feed screw which is connected with the thread of the pillar. The feed screw passes through the hole in the PCB and the hole on the feeder line, and then the feed screw and the feeder line are welded together.

Embodiment C

FIGS. 1 to 7 illustrate a 5G antenna element in this embodiment, which is similar to Embodiment A and Embodiment B. The length, width, and height of the cavity are ranging $\frac{1}{2}\lambda\sim\lambda$, $\frac{1}{10}\lambda\sim\frac{1}{2}\lambda$, and $\frac{1}{8}\lambda\sim\frac{1}{2}\lambda$, respectively. The length, width, and height of the pillar are ranging $\frac{3}{16}\lambda\sim\frac{3}{8}\lambda$, $\frac{1}{8}\lambda\sim\frac{1}{4}\lambda$, and $\frac{1}{15}\lambda\sim\frac{1}{8}\lambda$ ($\lambda$ is the wavelength of 28 GHz in free space), respectively. The long side of the pillar parallels to the broadside of the reflecting cavity.

The size of the reflecting cavity and the pillar should be set according to the operating wave length of the antenna element, so that a wide impedance bandwidth and a good directional radiation pattern of the antenna element can be obtained. In this embodiment, through adjusting the position and size of the reflecting cavity and the pillar, the antenna element can achieve a wide impedance bandwidth and the radiation on the front of the mobile terminal can be reduced greatly.

Embodiment D

FIGS. 1 to 7 illustrate the 5G antenna element in this embodiment, which is similar to Embodiment A and Embodiment B. The ratio of the reflecting cavity's length to the pillar's length is 12:5. The ratio of the reflecting cavity's width to the pillar's width is 11:5. The ratio of the reflecting cavity's height to the pillar's height is 3:2. The length, width and height of the reflecting cavity are $\frac{1}{2}\lambda\sim\lambda$, $\frac{1}{10}\lambda\sim\frac{1}{2}\lambda$, and $\frac{1}{8}\lambda\sim\frac{1}{2}\lambda$ ($\lambda$ is the wavelength of 28 GHz in free space), respectively. The long side of the pillar parallels to the broadside of the reflecting cavity.

The size of the reflecting cavity and the pillar should be set according to the operating wave length of the antenna element, so that a wide impedance bandwidth and a good directional radiation pattern of the antenna element can be obtained. In this embodiment, several shapes and sizes of the pillar are simulated and tested based on the above mentioned size of the reflecting cavity, and the pillar that meets the above mentioned ratio can achieve the best radiation performance.

Embodiment E

Figure 10:
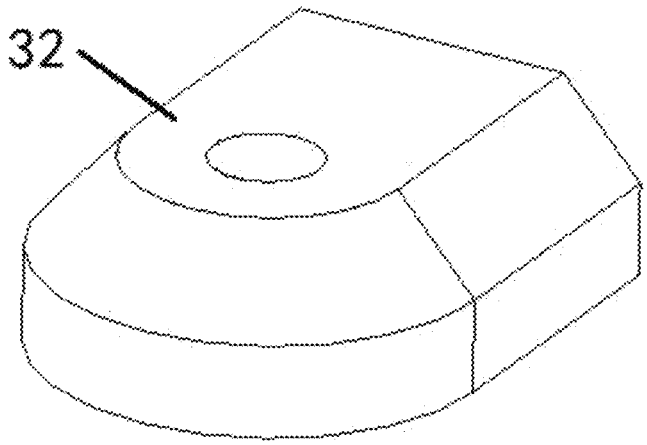
FIGS. 10 and 11 illustrate examples schematics of the pillar structure in embodiment E in accordance with this disclosure.
Figure 11:
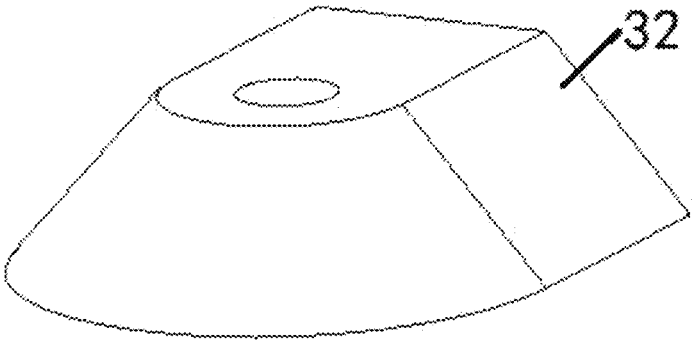
Figure 12:
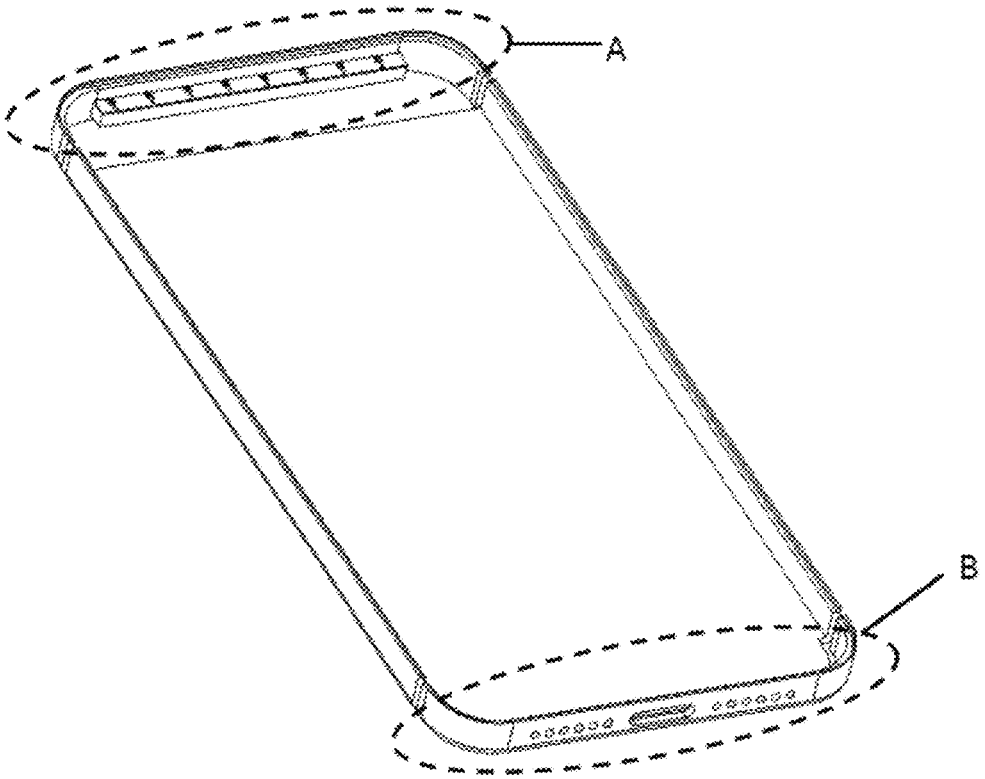
FIG. 12 illustrates an example schematic of the wide band antenna structure in accordance with this disclosure.

The 5G antenna element in this embodiment is similar to the one in Embodiments to D, as illustrated in FIG. 10. The shape of the longitudinal section of the pillar can be a trapezoid, as illustrated in FIG. 11. The shape of the longitudinal section of the pillar can be a triangle. The feeder line is printed on the PCB, which is composed by a feeder head and a The length and width of the feeder head are $0.08\lambda\sim0.12\lambda$ and $0.08\lambda\sim0.12\lambda$, respectively. The hole on the feeder line is drilled for the feed screw to pass through. As illustrated in FIG. 12, zone A is the position of the LTE diversity antenna, GPS/WIFI/BT antennas and the 5G antenna, and zone B is the position of the LTE main antenna.

Embodiment F

Figure 13:
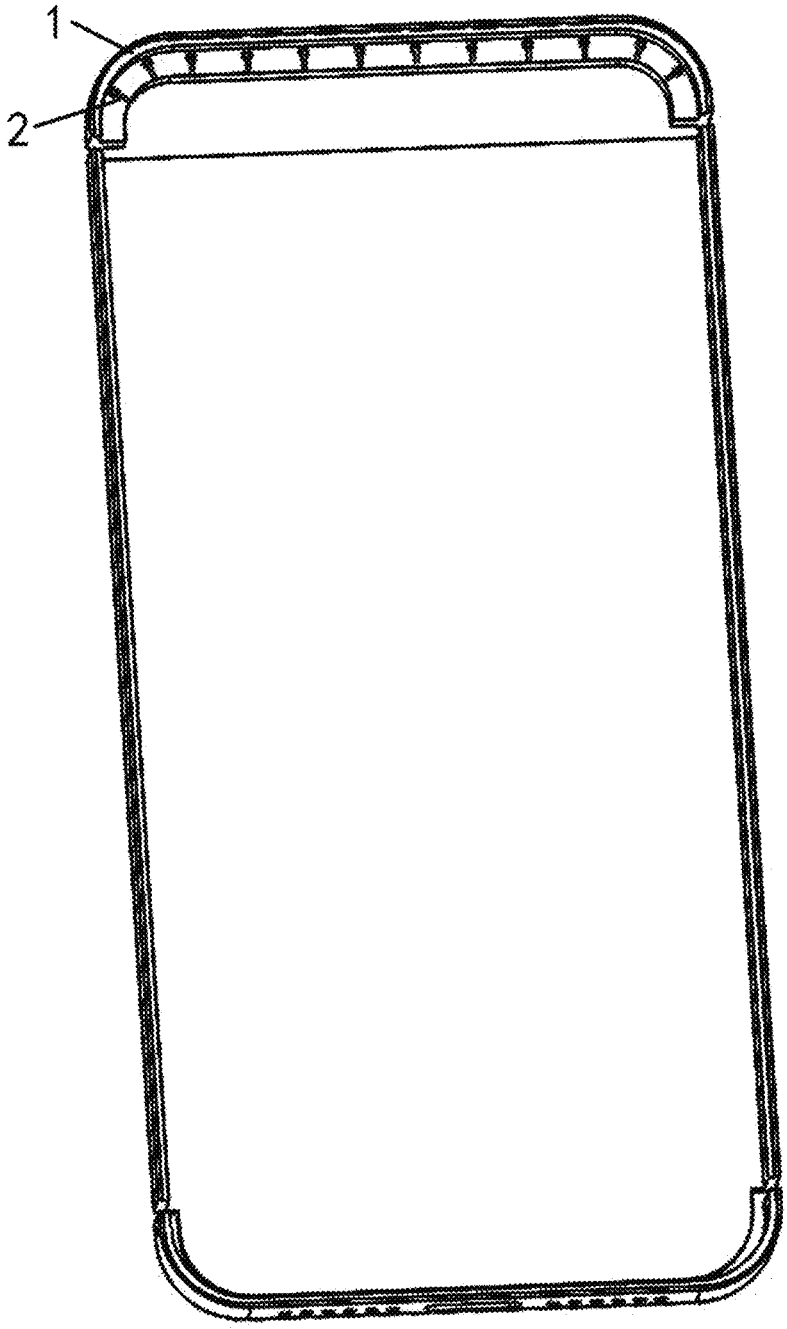
FIG. 13 illustrates an example schematic of the antenna elements position along the metal frame in accordance with this disclosure.

As illustrated in FIG. 13, the 5G antenna element in this embodiment is similar to the one in Embodiments 1 to 5, and the difference is that 12 antenna elements are arranged along the U-shaped metal frame.

The size of the antenna elements located on a straight edge and a bending edge of the metal frame are the same. Because the antenna elements are located on both the straight edge and the bending edge of the metal frame, so the beam scanning angle is wider.

Embodiment G

Figure 14:
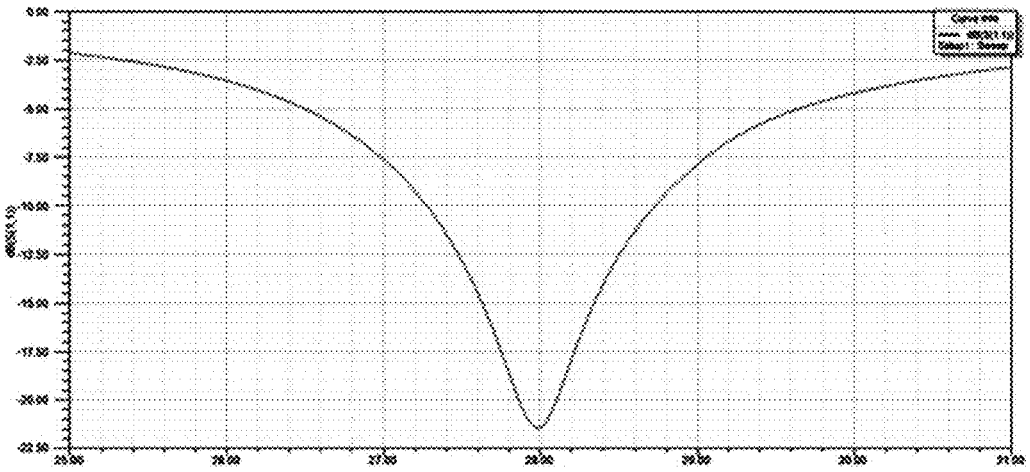
FIG. 14 illustrates an example reflection coefficient curve diagram of an antenna element operating at 25-31 GHz in FIG. 1 in accordance with this disclosure.
Figure 15:
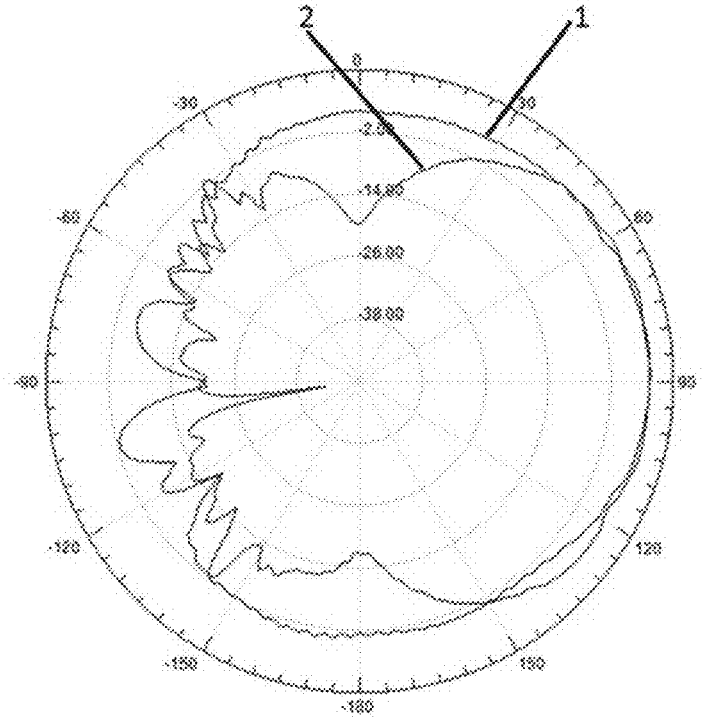
FIG. 15 illustrates an example radiation pattern of an antenna element operating at 28 GHz in FIG. 1 in accordance with this disclosure.
Figure 16:
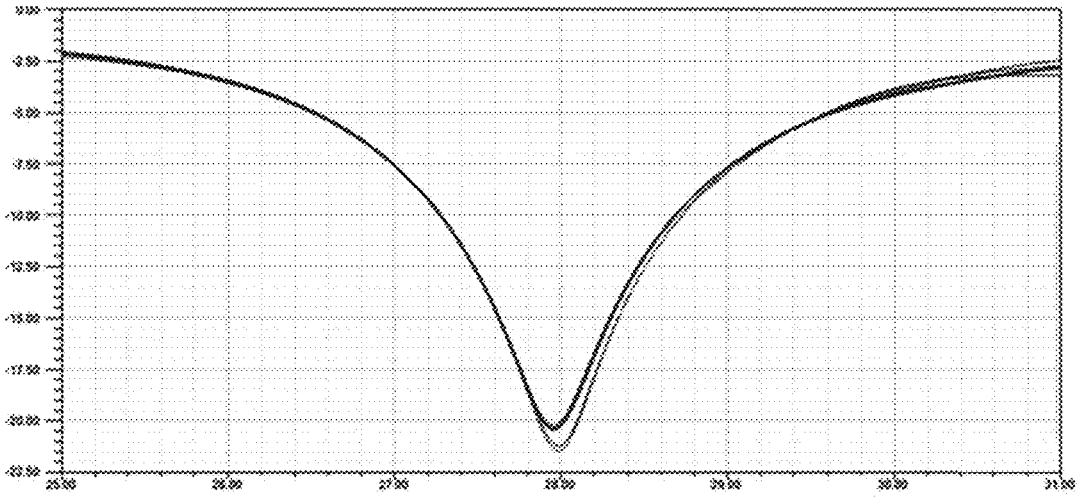
FIG. 16 illustrates an example reflection coefficient curve diagram of 8 antenna elements operating at 25-31 GHz in FIG. 1 in accordance with this disclosure.

As illustrated in FIGS. 14 to 21, this embodiment is similar to the one in Embodiment C. FIG. 14 illustrates the reflection coefficient curve diagram of the antenna element operating at 26-31 GHz. FIG. 15 illustrates a two-dimensional (2D) radiation pattern of the antenna element operating at 28 GHz, and curve 1 denotes the radiation pattern of the vertical section, and curve 2 denotes the radiation pattern of the horizontal section. FIG. 16 illustrates a reflection coefficient curve diagram of the 8 antenna elements array operating at 26-31 GHz. FIGS. 17 to 21 illustrate the radiation patterns of the eight antenna elements array. The phase differences between the adjacent antenna elements are 0 degree, 45 degree, 90 degree, 135 degree, and 170 degree, respectively.

Figure 17:
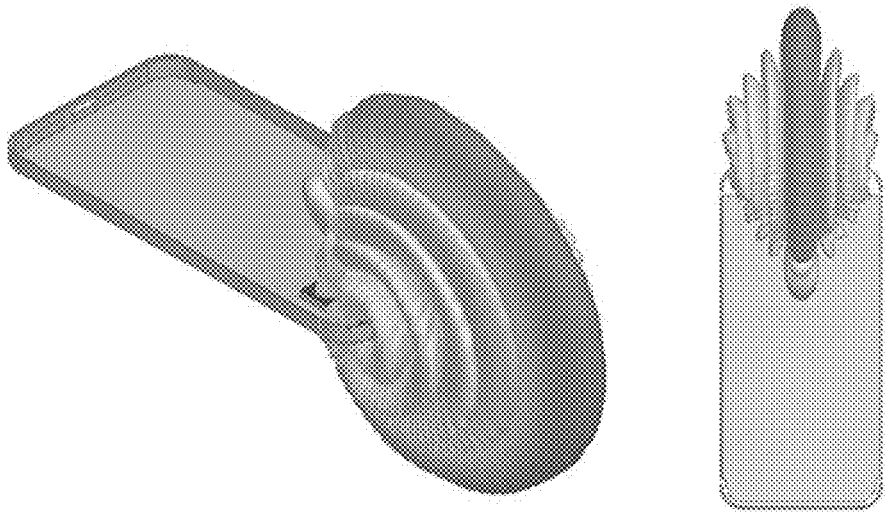
FIG. 17 illustrates an example three-dimensional (3D) radiation pattern of the antenna array with 0 degree phase difference between each element in accordance with this disclosure.
Figure 18:
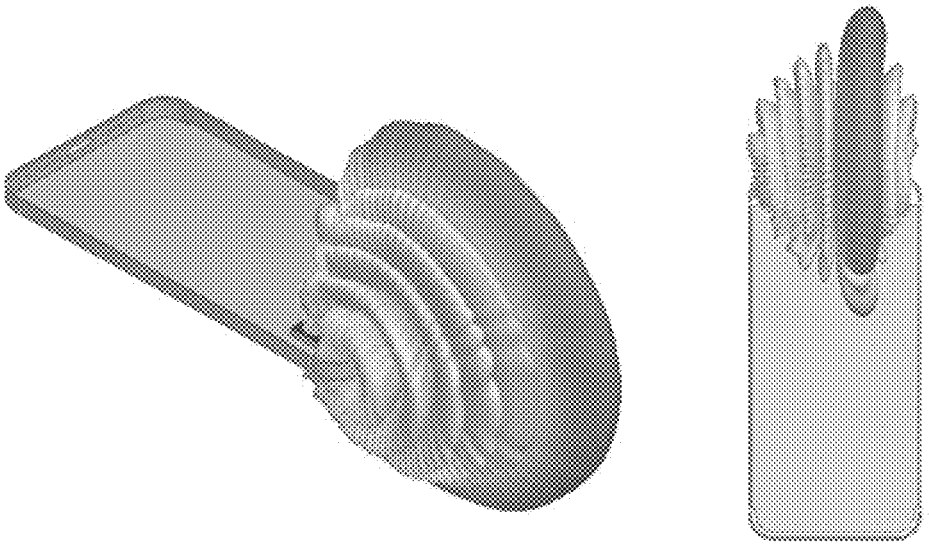
FIG. 18 illustrates an example 3D radiation pattern of the antenna array with 45 degree phase difference between each element in accordance with this disclosure.
Figure 19:
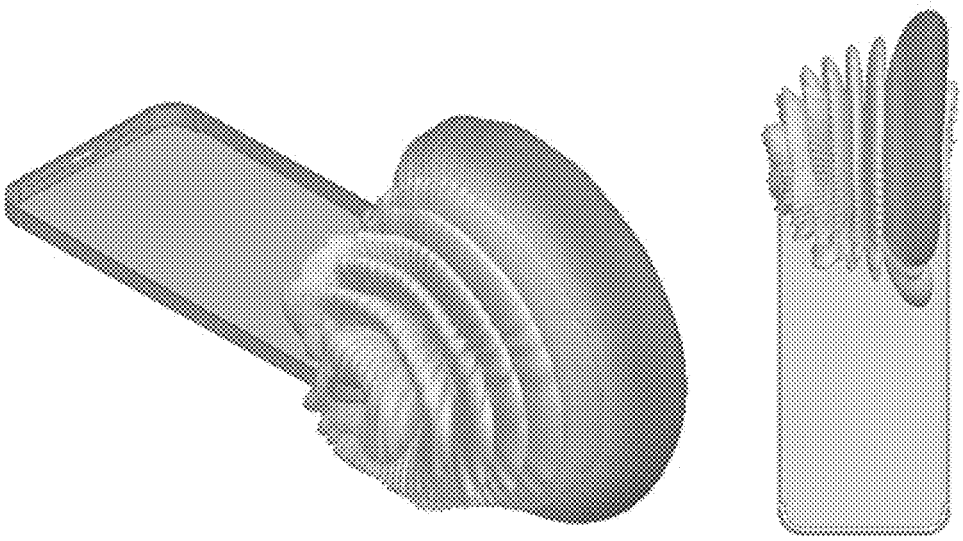
FIG. 19 illustrates an example 3D radiation pattern of the antenna array with 90 degree phase difference between each element in accordance with this disclosure.
Figure 20:
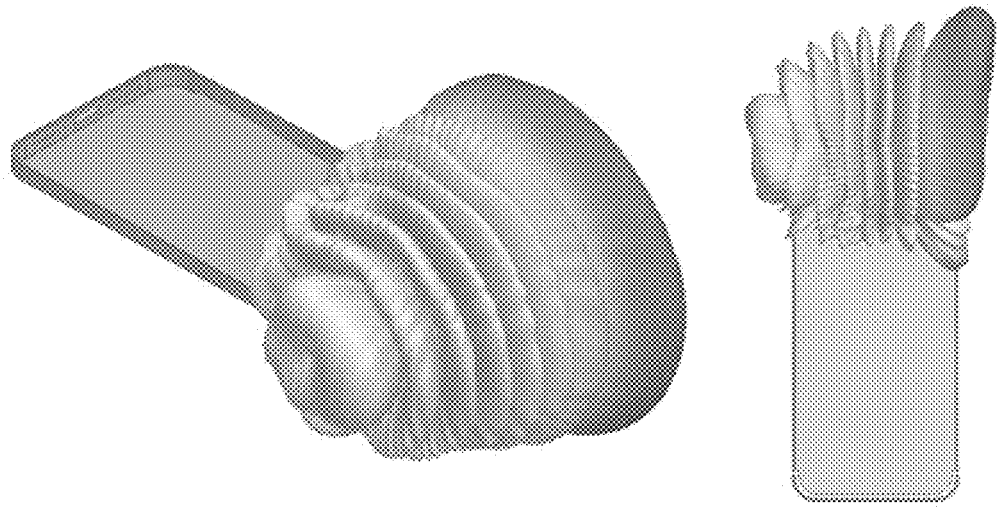
FIG. 20 illustrates an example 3D radiation pattern of the antenna array with 135 degree phase difference between each element in accordance with this disclosure.
Figure 21:
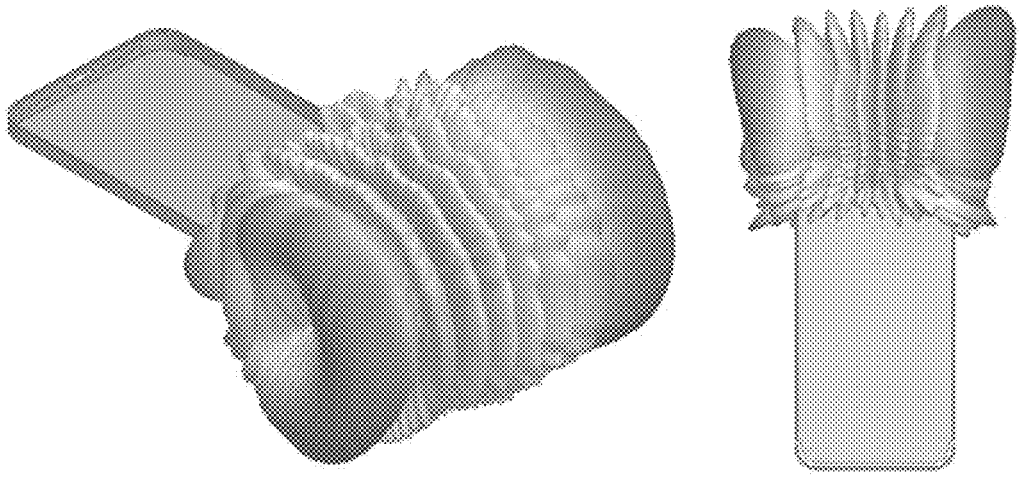
FIG. 21 illustrates an example 3D radiation pattern of the antenna array with 170 degree phase difference between each element in accordance with this disclosure.

As illustrated in FIG. 17, a radiation direction is 0 degree when a phase difference between the adjacent antenna elements is 0 degree. As illustrated in FIG. 18, the radiation direction tilts 12 degree when the phase difference between the adjacent antenna elements is degree. As illustrated in FIG. 19, the radiation direction tilts 26 degree when the phase difference between the adjacent antenna elements is 90 degree. As illustrated in FIG. 20, the radiation direction tilts 36 degree when the phase difference between the adjacent antenna elements is 135 degree. As illustrated in FIG. 21, the radiation direction tilts 48 degree when phase difference between the adjacent antenna elements is 170 degree. Embodiment G describes the beam scanning pattern of the 8 antenna elements array that is integrated on the side of the metal frame, and its scanning angle is from −48 degree to 48 degree.

Embodiment H

Figure 22:
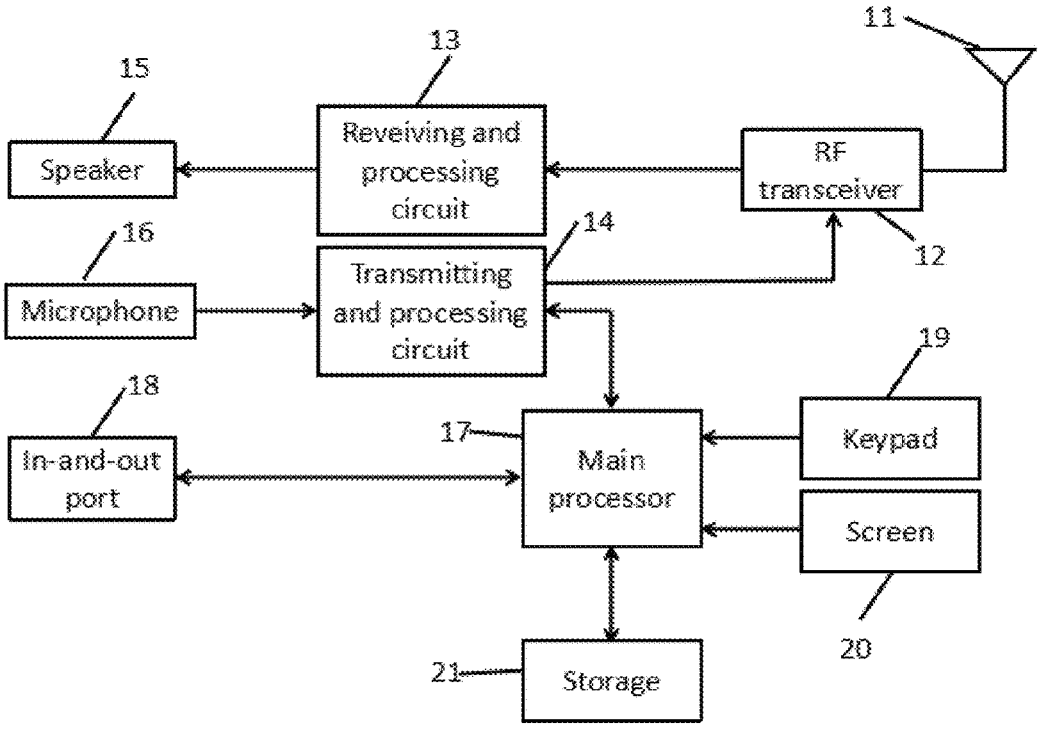
FIG. 22 illustrates an example schematic of a 5G antenna system structure in accordance with this disclosure.
Figure 23:
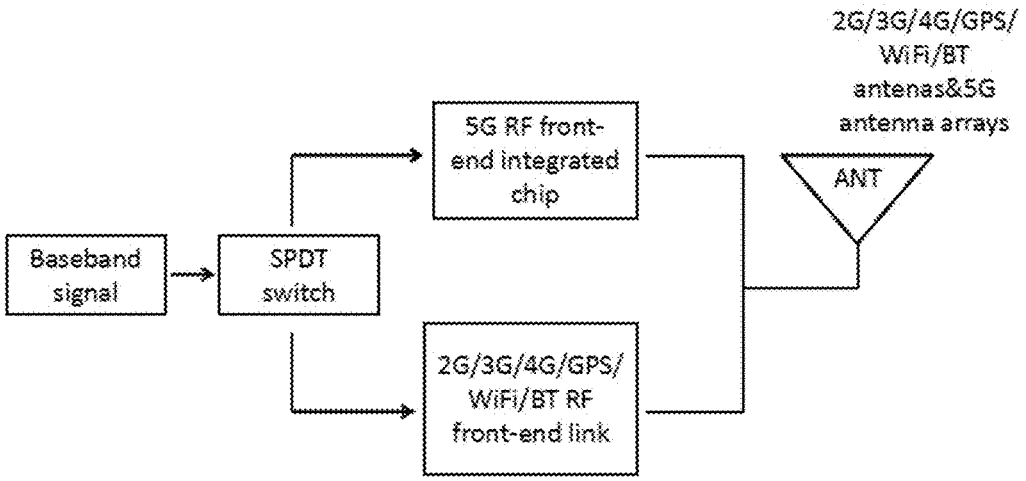
FIG. 23 illustrates an example schematic of a RF frontend module structure in accordance with this disclosure.

FIG. 22 and FIG. 23 illustrate an antenna system in this embodiment, which is similar to the antenna in Embodiments A to G. The mobile terminal system with above mentioned antenna systems includes an antenna array 11, an RF frontend module 12, a base band receiving & processing circuit 13, a base band transmitting & processing circuit 14, a speaker 15, a microphone 16, a main processor 17, an input and output port 18, a keyboard a screen 20, and a memory 21. The RF frontend module receives an RF signal from the base stations through the antenna array and produces an intermediate frequency (IF) signal and a baseband signal through a down conversion module. The baseband signal is filtered and decoded via receiver (RX) circuit 13, and the above processed signal is transmitted to the speaker 15 or the main processor 17 for further processing. The RX circuit 14 receives a voice signal from microphone 16 and a baseband signal from the main processor 17. After digitally processed in transmitter (TX) circuit 14, the baseband signal will be up-converted to be an RF signal which can be transmitted by the antenna array 11. The RF frontend module includes a RF frontend module and a 2G/3G/4G/GPS/WIFI/BT RF frontend module and above two RF frontend modules are connected by a single-pole-double-throw (SPDT) switch which connected with baseband transceiver module. The baseband signal can be switched between 5G RF frontend module and the 2G/3G/4G/GPS/WIFI/BT RF frontend module through the SPDT switch.

Obviously, the above embodiments of the present invention are merely for the purpose of clearly stating examples of the invention rather than the limitation of the embodiments of the present invention. As for those skilled in the art in the field, there may be other variations or variations on the basis of the foregoing instructions. There is no need to be exhaustive of all implementations. Any modifications, equivalents, substitutions and improvements made within the spirit and principles of the present invention shall be included in the scope of protection of the claims of the present invention. Several embodiments of the present innovation have been described thus far, but the present innovation is not limited to these embodiments.

What is claimed is:

1. A broadband antenna element, comprising:

a reflecting cavity, the reflecting cavity having a metal frame, a feeder line, a feed screw, a pillar, and an insulating sleeve, wherein the reflecting cavity is formed by an inner concave of an outer side of a metal frame, wherein the reflecting cavity further includes a first wall and a second wall distributed from bottom to top, wherein the first wall, the pillar, the second wall, and the feeder line are arranged orderly and are connected with a feed screw, wherein the pillar and the feed screw are connected by screw thread, wherein the feed screw is connected with the second wall through an insulating sleeve, wherein the pillar is a good conductor and its under surface contacts with the first wall, and wherein an under surface area of the pillar is larger than an upper surface area of the pillar.

2. The broadband antenna element of claim 1, wherein a shape of a longitudinal section of the pillar is a trapezoid with a curved edge, a trapezoid with a straight edge, or a step shape.

3. The broadband antenna element of claim 1, wherein a shape of a cross section of the pillar is an arch shape, which is a combination of a semicircle and a rectangular.

4. The broadband antenna element of claim 1, wherein a working wavelength of the antenna element is λ, wherein a the length, a width, and a height of the reflecting cavity are ½~λ, 1/10λ~½λ, and ⅛λ~½λ, respectively, wherein a length, a width, and a height of the pillar are 3/16λ~⅜λ, ⅛λ~¼λ, and 1/15λ~⅛λ, respectively, and wherein a long side of the pillar is parallel to a broadside of the reflecting cavity.

5. The broadband antenna element of claim 1, wherein a working wavelength of the antenna element is λ, wherein a length, a width, and a height of the reflecting cavity are ½λ~λ, 1/10λ~½λ, and ⅛λ~½λ, respectively, wherein a ratio of the reflecting cavity's length to the pillar's length is 12:5, wherein a ratio of the reflecting cavity's width to the pillar's width is 11:5, wherein a ratio of the reflecting cavity's height to the pillar's height is 3:2, and wherein a long side of the pillar is parallel to a broadside of the reflecting cavity.

6. The broadband antenna element of claim 4, wherein a length of an end part of the feeder line is 0.08λ~0.12λ, and a width of the end part of the feeder line is 0.08λ~0.12λ.

7. The broadband antenna element of claim 1, wherein the feed screw includes a screw head and a screw column, and wherein the screw head is located at an end of the feed screw that is close to the first wall.

8. The broadband antenna element of claim 1, wherein the reflecting cavity can be filled with low loss material.

9. The broadband antenna element of claim 1, wherein the metal frame is a U-shape frame which is placed at a topside of a mobile device, and wherein the antenna elements are distributed along the U-shaped frame.

10. The broadband antenna element of claim 1, wherein the reflecting cavity and the pillar are connected with each other and are formed by an opening slot on the metal frame through a computer numerical control (CNC) process.

11. A mobile terminal system, comprising:

a radio frequency (RF) frontend module;

a main processor;

a baseband transceiver module, wherein the RF frontend module includes a 5G RF frontend module and a 2G/3G/4G/GPS/WIFI/BT RF frontend module, and wherein the 5G RF frontend module and the 2G/3G/4G/GPS/WIFI/BT RF frontend module are connected by a signal switch which is connected with baseband transceiver module; and a broadband antenna, wherein the broadband antenna includes a reflecting cavity, the reflecting cavity having a metal frame, a feeder line, a feed screw, a pillar, and an insulating sleeve, wherein the reflecting cavity is formed by an inner concave of an outer side of a metal frame, wherein the reflecting cavity further includes a first wall and a second wall distributed from bottom to top, wherein the first wall, the pillar, the second wall, and the feeder line are arranged orderly and are connected with a feed screw, wherein the pillar and the feed screw are connected by screw thread, wherein the feed screw s connected with the second wall through an insulating sleeve, wherein the pillar is a good conductor and its under surface contacts with the first wall, and wherein an under surface area of the pillar is larger than an upper surface area of the pillar.

12. The mobile terminal system of claim 11, wherein a shape of a longitudinal section of the pillar is a trapezoid with a curved edge, a trapezoid with a straight edge, or a step shape.

13. The mobile terminal system of claim 11, wherein a shape of a cross section of the pillar is an arch shape, which is a combination of a semicircle and a rectangular.

14. The mobile terminal system of claim 11, wherein a working wavelength of the antenna element is λ, wherein a the length, a width, and a height of the reflecting cavity are ½λ~λ, 1/10λ~½λ, and ⅛λ~½λ, respectively, wherein a length, a width, and a height of the pillar are 3/16λ~⅜λ, ⅛λ~¼λ, and 1/15λ~⅛λ, respectively, and wherein a long side of the pillar is parallel to a broadside of the reflecting cavity.

15. The mobile terminal system of claim 11, wherein a working wavelength of the antenna element is λ, wherein a length, a width, and a height of the reflecting cavity are ½λ~λ, 1/10λ~½λ, and ⅛λ~½λ, respectively, wherein a ratio of the reflecting cavity's length to the pillar's length is 12:5, wherein a ratio of the reflecting cavity's width to the pillar's width is 11:5, wherein a ratio of the reflecting cavity's height to the pillar's height is 3:2, and wherein a long side of the pillar is parallel to a broadside of the reflecting cavity.

16. The mobile terminal system of claim 14, wherein a length of an end part of the feeder line is 0.08λ~0.12λ, and a width of the end part of the feeder line is 0.08λ~0.12λ.

17. The mobile terminal system of claim 11, wherein the feed screw includes a screw head and a screw column, and wherein the screw head is located at an end of the feed screw that is close to the first wall.

18. The mobile terminal system of claim 11, wherein the reflecting cavity can be filled with low loss material.

19. The mobile terminal system of claim 11, wherein the metal frame is a U-shape frame which is placed at a topside of a mobile device, and wherein the antenna elements are distributed along the U-shaped frame.

20. The mobile terminal system of claim 11, wherein the reflecting cavity and the pillar are connected with each other and are formed by an opening slot on the metal frame through a computer numerical control (CNC) process.

* * * * *